US007475580B1

(12) United States Patent
Page

(10) Patent No.: US 7,475,580 B1
(45) Date of Patent: Jan. 13, 2009

(54) PIPE BENDING CLINOMETER

(76) Inventor: Donald L Page, 3227 Eckleson St., Lakewood, CA (US) 90712

( * ) Notice: Subject to any disclaimer, the term of this patent is extended or adjusted under 35 U.S.C. 154(b) by 0 days.

(21) Appl. No.: 11/854,995

(22) Filed: Sep. 13, 2007

(51) Int. Cl.
*B21D 7/14* (2006.01)
*B21J 13/08* (2006.01)

(52) U.S. Cl. ..... 72/31.05; 72/459

(58) Field of Classification Search ..... 72/31.04, 72/31.05, 31.1, 459; 33/1 N, 412, 529, 534, 33/538

See application file for complete search history.

(56) References Cited

U.S. PATENT DOCUMENTS

| | | | |
|---|---|---|---|
| 961,555 | A | 6/1910 | Tedesco |
| 2,832,152 | A | 4/1958 | Blackshaw |
| 3,038,261 | A | 6/1962 | Blain |
| 4,425,784 | A | 1/1984 | D'Gerolamo |
| 4,587,832 | A | 5/1986 | Illguth |
| 5,144,823 | A | 9/1992 | Wood |
| 5,167,075 | A | 12/1992 | Wendy et al. |
| 5,290,166 | A | 3/1994 | Heatherly |
| 5,669,258 | A | 9/1997 | Luebke |
| 6,209,371 | B1 | 4/2001 | Guinn |
| 6,385,856 | B1 | 5/2002 | Godin |
| 6,834,527 | B2 | 12/2004 | Hopwood |

FOREIGN PATENT DOCUMENTS

| | | |
|---|---|---|
| CA | 2421025 | 9/2004 |
| DE | 3705859 | 9/1988 |
| EP | 1473537 | 11/2004 |
| GB | 24049 | 0/1904 |

*Primary Examiner*—Derris H Banks
*Assistant Examiner*—Teresa Bonk
(74) *Attorney, Agent, or Firm*—Michael I Kroll

(57) ABSTRACT

A pipe bending angle indicator comprising two protractors with pivoting pointers. The protractors are mounted to stand-offs which in turn are mounted to their respective bases. The base holds the tool in the proper position. The base is held onto the conduit by means of an elastic cord. The elastic cord is stretched tightly around the conduit and secured in a notch in the clip at the stand-off. The stand-off allows the string to clear any pins, or protrusions as the bending progresses.

16 Claims, 10 Drawing Sheets

PIPE BENDING CLINOMETER

BACKGROUND OF THE INVENTION

1. Field of the Invention

The present invention relates generally to Geometric Instruments and, more specifically, to a pipe bending angle indicator. The present invention is a tool that enables the operator of any bending device to quickly, simply and accurately determine the angle of a conduit as it is being bent without removing it from the bending device to do so. This tool consists of two protractors with pivoting pointers. The protractors are mounted to stand-offs which in turn are mounted to their respective bases. The base holds the tool in the proper position. The base is held onto the conduit by means of an elastic cord. The elastic cord is stretched tightly around the conduit and secured in a notch in the clip at the stand-off. The stand-off allows the string to clear any pins, or protrusions as the bending progresses.

2. Description of the Prior Art

There are other geometric indicators designed for angular inclination. Typical of these is U.S. Pat. No. 961,555 issued to Tedesco on Jun. 14, 1910.

Another patent was issued to Blackshaw on Apr. 29, 1958 as U.S. Pat. No. 2,832,152. Yet another U.S. Pat. No. 3,038,261 was issued to Blain on Jun. 12, 1962 and still yet another was issued on Jan. 17, 1984 to D'Gerolamo as U.S. Pat. No. 4,425,784.

Another patent was issued to Illguth on May 13, 1986 as U.S. Pat. No. 4,587,832. Yet another U.S. Pat. No. 5,144,823 was issued to Wood on Dec. 1, 1992. Another was issued to Weldy, et al. on Dec. 1, 1992 as U.S. Pat. No. 5,167,075 and still yet another was issued on Mar. 1, 1994 to Heatherly as U.S. Pat. No. 5,290,166.

Another patent was issued to Luebke on Sep. 23, 1997 as U.S. Pat. No. 5,669,258. Yet another U.S. Pat. No. 6,209,371 was issued to Guinn on Apr. 3, 2001. Another was issued to Godin on May 14, 2002 as U.S. Pat. No. 6,385,856 and still yet another was issued on Dec. 28, 2004 to Hopwood as U.S. Pat. No. 6,834,527.

Another patent was issued to Ricono on Mar. 10, 1904 as U.K. Patent No. GB24,049. Yet another German Patent No. DE3705859 was issued to Schoenig on Sep. 1, 1988. Another was issued to Hauzie, Eugene Jr. on May 9, 2004 as Canada Patent No. CA2421025 and still yet another was issued on Nov. 3, 2004 to Ellis as European Patent Application No. EP1473537.

U.S. Pat. No. 961,555

Inventor: Thomas G. Tedesco

Issued: Jun. 14, 1910

A device of the class described comprising an inner plug and an outer annular plug, said inner plug adapted to be threaded into said outer plug, and said outer plug adapted to be threaded into the end of a pipe, said inner plug provided with a hook adapted to be engaged by a cord.

U.S. Pat. No. 2,832,152

Inventor: Joseph T. Blackshaw

Issued: Apr. 29, 1958

A layout means for welded offsets, comprising: a pair of members adapted for longitudinal and circumferential adjustment on a pair of pipe sections to be joined; an arm structure pivotally connected to each member and defining planes passing through their pivotal connections with said members; tension means for drawing said arm structures into position wherein said planes of both arm structures pass through a line extending between the axes of said pipe sections; means for measuring the relative circumferential displacement of said planes; and means for measuring the angular relationship of said members and said arm structures.

U.S. Pat. No. 3,038,261

Inventor: Griffin C. Blain

Issued: Jun. 12, 1962

A pipe layout apparatus, comprising: a rod; a base adapted to lie upon a first pipe and to support said rod radially of said pipe; a second rod; a base adapted to lie upon a second pipe and to support said second rod radially of said second pipe; a protractor mounted normally to said first rod; and a linear element of adjustable length extending between substantially identically located points on said rods, being connected to said first rod at the junction thereof with the center of said protractor whereby when said rods are adjusted to co-planar positions and said element is concurrently disposed in the plane of said protractor, said element indicates on said protractor the angle included between said first pipe and the plane including said rods.

U.S. Pat. No. 4,425,784

Inventor: Frank D'Gerolamo

Issued: Jan. 17, 1984

A device for indicating the angular movement of a tube bender and the like is disclosed comprising a plate assembly having an alignment groove for attaching, in desired position, the plate to the elongated handle of the tube bender, and wherein the plate assembly has an arcuate spirit level with an angular movement position indicator air bubble inside and has angle marked surface adjacent the arcuate spirit level.

U.S. Pat. No. 4,587,832

Inventor: Frank J. Illguth

Issued: May 13, 1986

A tube bending tool for bending tubing, such as electrical metal tubing or plumbing tubing, signals the user by an indicator such as an audible signaling device when the tubing has been bent to a predetermined angle. The tool includes a bending anvil with a tube receiving area such as a tube receiving groove which receives the tube as it is bent, the greater the length of tube received by the groove the greater the degree of bend in the tube. A plurality of sensors such as switches are spaced along the tube receiving area so that as the tube is received by predetermined locations along the tube receiving area, a sensor changes state. A selector switch is coupled to an indicator and power source so that when a selected sensor changes state, indicating a predetermined degree of tube bend has been obtained, the indicator is activated.

U.S. Pat. No. 5,144,823

Inventor: Gary J. Wood

Issued: Sep. 8, 1992

A removable attachment for a tube bender or for the tube to be bent for predetermining a selected bend angle to which the tube is to be bent prior to the bending operation. In a first embodiment of the device, an audio and/or visual indicator indicates when the desired bend angle is achieved. In a second embodiment of the device, an audio indicator indicates during the bending operation when the desired bend angle is being approached and a second audio/visual indication indicates when the desired bend angle is achieved. In both embodiments an electrical continuity tester is provided.

U.S. Pat. No. 5,167,075

Inventor: Philip D. Wendy, et al.

Issued: Dec. 1, 1992

A level/protractor tool which includes two or more sections pivotally joined to facilitate angular displacement. One or more sections house level-indicating spirit vials. Angular displacement indicia marks are imprinted on each section at its juncture with an adjoining section to visually indicate the degree of angular displacement between adjacent sections.

U.S. Pat. No. 5,290,166

Inventor: Galen K. Heatherly

Issued: Mar. 1, 1994

The device includes a left arm (11) and a right arm (10) hingeably connected about a protractor scale (12). A left clamp and a right clamp (13 and 13') are slidably attached to the arms such that the spacing between the clamps is adjustable. Locking knobs (24A, 24B, 24A', and 24B') hold the clamps at the desired locations. Left and right socket formers (29 and 29') are slidably attached to the left and right clamps, respectively. Left and right levers (34 and 34') are used to extend the socket formers into a heated pipe (37) placed between the clamps to form integral pipe connecting sockets in the ends of the pipe. (A flexible mandrel is placed inside the pipe to prevent it from collapsing). Bending the arms to a desired angle on the protractor will bend the pipe to the same angle. Locking knob (18) holds the arms in place while the pipe cools. After the pipe is cooled and hardened, the levers are used to retract the socket formers from the pipe to release the pipe.

U.S. Pat. No. 5,669,258

Inventor: Thomas M. Luebke

Issued: Sep. 23, 1997

A tube bender angle indicator is attached to the handle of a manual tube bender and has a frame to which angle indicia are applied which define an apex through which a pointer is pivotally connected to the frame. A bubble level vial is secured to the pointer so as to indicate that the bend angle has been achieved which the pointer is pointing at when the bubble is in its horizontal reference position.

U.S. Pat. No. 6,209,371

Inventor: Ricky Guinn

Issued: Apr. 3, 2001

An angle indicator is provided for use with a pipe bender and is adapted to be removably mounted to a handle of a pipe bender. The angle indicator includes a plate; a first wheel rotatably mounted to the plate and including a plurality of angle indicating marks evenly spaced about a periphery of the first wheel; a second wheel rotatably mounted to the plate concentrically with the first wheel; the second wheel being smaller in diameter than the first wheel and including a mark at a periphery of the second wheel, the mark being selectively alignable with one of the angle indicating marks of said first wheel; a bubble level mounted on the second wheel; a first lock to hold the first wheel in a desired rotational position; and a second lock to hold the second wheel in a desired rotational position. The use of two wheels allows for zeroing of the angle indicator and dialing in of the desired angle.

U.S. Pat. No. 6,385,856

Inventor: Jeffrey L. Godin

Issued: May 14, 2002

An economical, compact guide for introducing multiple bends in one or more planes in a pipe, conduit, or other tube-like item. The guide has a gauge section rotatably attached to a mounting section and is affixable by means of a non-deforming clamp to the end of a pipe segment to be bent. The gauge section has a bend-angle gauge and a bend-plane level. The bend-angle gauge is a plumb arm mounted so as to measure and indicate the bending of a pipe to any degree of bend. The bend-plane guide is a 360.degree level mounted on an upper face of the plumb arm. Multiple bends are made in the pipe segment without removing or re-aligning the guide. This ensures that the initial reference position is maintained throughout the bending process and ensures that all bends are in the proper bend-plane, thus avoiding "dogging" between successive bends. Multiple successive bend-planes also may be established without removing or re-aligning the guide on the pipe, by rotating the gauge section of the guide relative to the mounting section by the magnitude of the desired out-of-plane angle.

U.S. Pat. No. 6,834,527

Inventor: Gregory Hopwood

Issued: Dec. 28, 2004

An adjustable mechanical stop for a tube bender is disclosed. The tube bender includes an elongated arm having a pivoting end and a free end, wherein the pivoting end is pivotally connectable to a tube bender. A stop is disposed at the free end of the elongated arm, wherein the stop is disposed to engage a tube in the tube bender. A lock is disposed along the elongated arm, wherein the lock is engageable with the tube bender to adjustably secure the stop relative to the tube bender. A tube bender incorporating the mechanical stop is also disclosed.

U.K. Patent Number GB24,049

Inventor: Domenico Ricono

Issued: Mar. 10, 1904

A combination tool having a protractor dial that is divided off into parts and centrally mounted on legs whose inside junction or apex forms a true right angle having a box with an enclosed plumb bob for indication angular inclination on the protractor.

Germany Patent Number DE3705859

Inventor: Antal Schoenig

Issued: Sep. 1, 1988

This inclinometer is used for checking the slope of a road section to be prepared, particularly the cross-sectional profile of a road body layer, a roadway surface or the like. The measuring element is located in a plane which goes perpendicularly through a fall line of the terrain section to be measured. The inclinometer consists of a protractor-like scale body (1), the circular-arc part (4) of which is provided with symbols (5) for degrees of arc and/or percent. At a point (8) provided on the plumb line going through the centre of the circular-arc part (4), a plumb line is attached which points to the zero symbol (10) identified on the circular-arc part (4) in the basic position of the scale body (1).

Canada Patent Number CA2421025

Inventor: Eugene Hauzie, Jr.

Issued: Sep. 5, 2004

A pipefitter's protractor is used to measure the angle between two separate pipes having an intersecting point. The protractor assembly includes a pipe attachment bar secured to the squared and of one pipe, with a protractor arm extending from the center of the pipe attachment bar and concentric with the centerline of the pipe. The protractor extends from the arm, with the arm and protractor rotating about the pipe attachment bar fitting to align the protractor plate coplanar with the plane defined by the pipes. The protractor is adjusted along the protractor arm to position the protractor origin at the intersection of the pipe centerlines, and a line is run from the origin to the second pipe. The angle between the pipes and the distances from the protractor origin to the ends of each pipe are then used for fabricating an elbow to join the pipes.

European Patent Application Number EP 1473537

Inventor: Merle R. Ellis

Published: Nov. 3, 2004

A multipurpose angle measuring device is provided for carpenters, roofers and other tradesmen. The elongated base is rectangular in cross sectional and includes a scale for measuring distances along one side. Pivotally affixed to the base is a level which can be locked against a protractor (also affixed to the base) at any angle between zero and ninety degrees (0 DEG-90 DEG). Roof pitches, gradients and other angles can be determined or set in a simple, easy to learn manner.

While these angle indicators may be suitable for the purposes for which they were designed, they would not be as suitable for the purposes of the present invention, as hereinafter described.

SUMMARY OF THE PRESENT INVENTION

A primary object of the present invention is to provide a device for indicating the angular bend of a pipe during the pipe bending process.

Another object of the present invention is to provide an angular indicator that is attachable to a pipe and is used in pairs having a length of line attached to each pointer.

Yet another object of the present invention is to provide an angle indicator wherein the indicated angle of each pointer is added to produce the cumulative degree of bend from the straight.

Additional objects of the present invention will appear as the description proceeds.

The present invention overcomes the shortcomings of the prior art by providing a pipe bending angle indicator comprising two protractors with pivoting pointers. The protractors are mounted to stand-offs which in turn are mounted to their respective bases. The base holds the tool in the proper position. The base is held onto the conduit by means of an elastic cord. The elastic cord is stretched tightly around the conduit and secured in a notch in the clip at the stand-off. The stand-off allows the string to clear any pins, or protrusions as the bending progresses.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
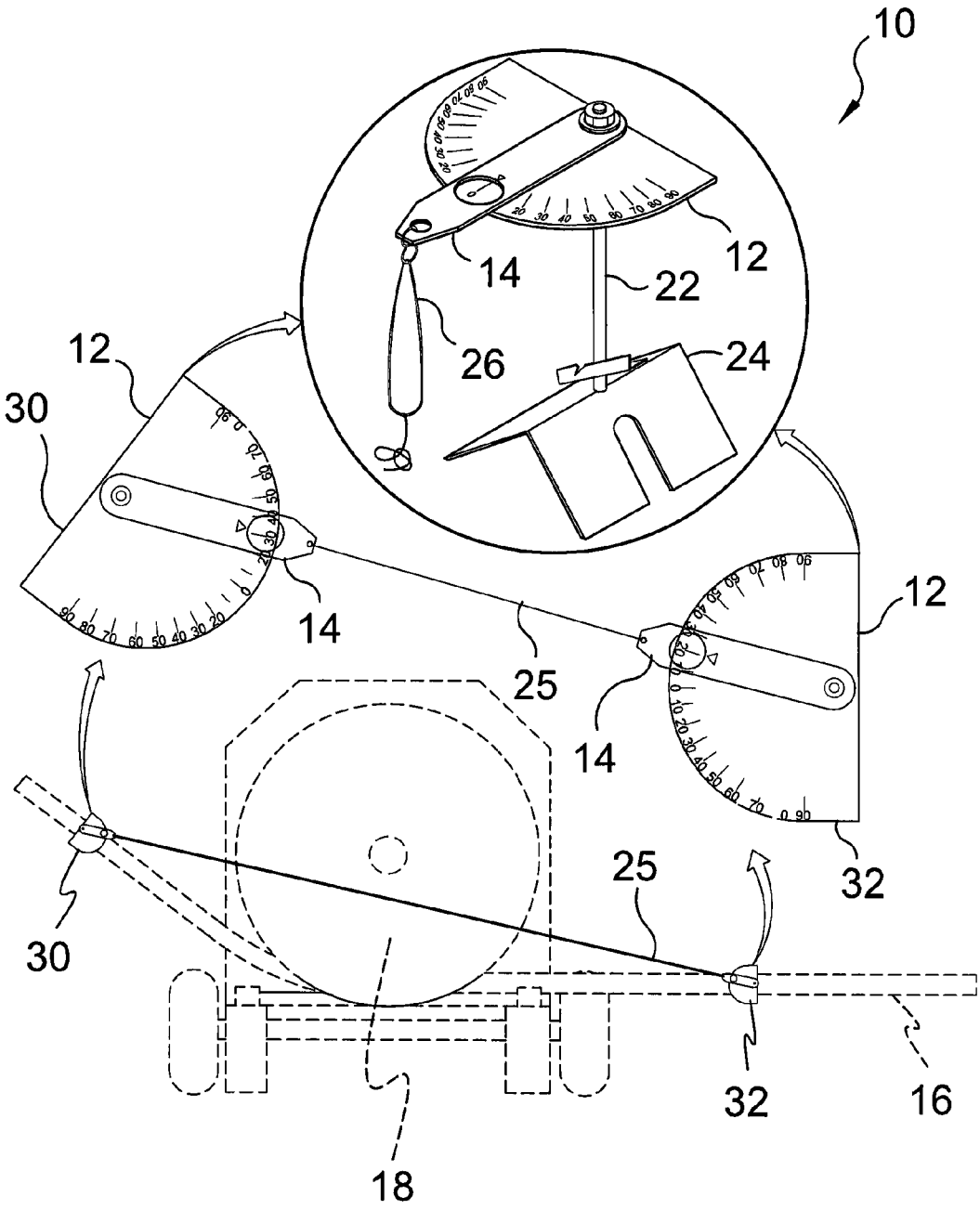
FIG. 1 is an illustrative view of the present invention.

Turning now descriptively to the drawings, in which similar reference characters denote similar elements throughout the several views, the figures illustrate the Pipe Bending Clinometer of the present invention. With regard to the reference numerals used, the following numbering is used throughout the various drawing figures.

10 Pipe Bending Clinometer of the present invention
12 protractor
14 pivoting pointer
16 conduit
18 bending device
22 stand off
24 base
25 tether line
26 elastomeric cord of 25
28 elastic band of 24
30 first indicator
32 second indicator
34 indicia
38 static line of 25
40 J-clip
42 attachment recess
44 attachment recess
46 base channel
48 base plate
50 hex nut
52 washer
54 threads of 22
56 sleeve spacer
58 friction washer
60 pointer tensioning assembly

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10. The present invention 10 is a tool that enables the operator of any bending device to quickly, simply and accurately determine the angle of a conduit 16 as it is being bent without removing it from the bending device 18 to do so. This tool consists of two protractors 20 acting as a first indicator 30 and a second indicator 32 with pivoting pointers 12 connected by a tether tension line 25. The protractors 12 are mounted to stand-offs 22 which in turn are mounted to their respective bases 24. The base 24 holds the tool in the proper position and is held onto the conduit 20 by means of an elastic band 24. The elastic band 24 is stretched tightly around the conduit 20 and secured in a notch in the clip at the stand-off 22. The stand-off 22 allows the string to clear any pins, or protrusions as the bending progresses.

Figure 2:
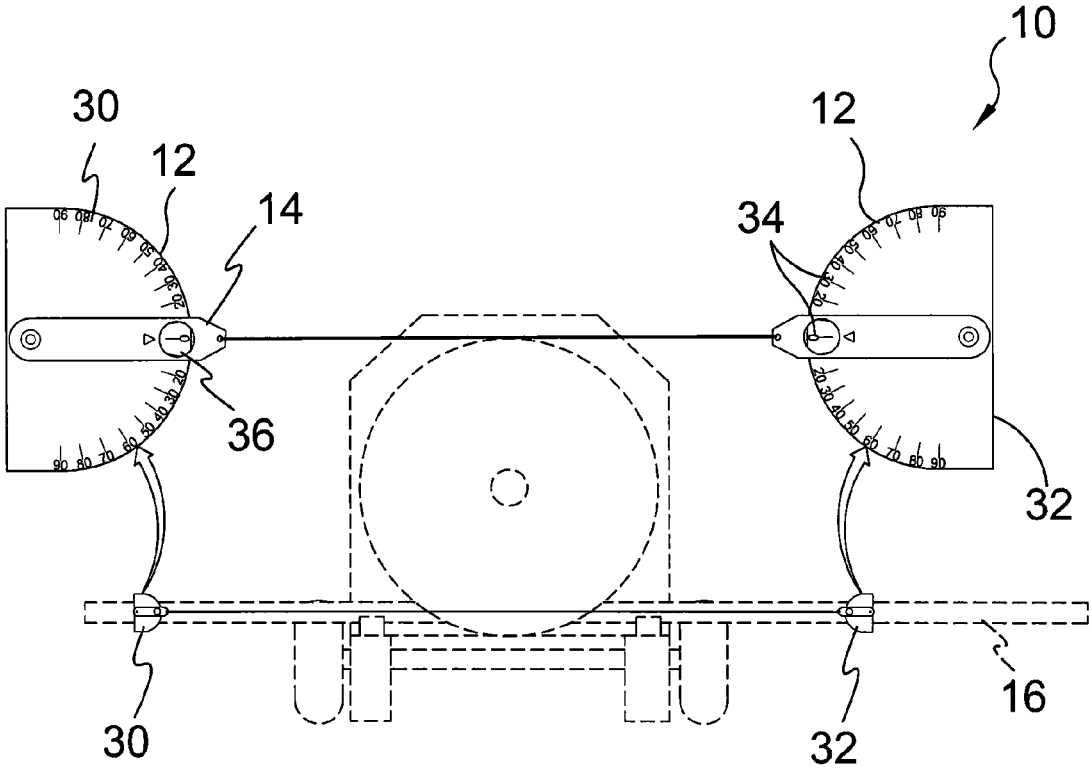
FIG. 2 is a perspective view of the present invention in use.

FIG. 2 is a perspective view of the present invention 10 in use. Shown is a the first indicator 30 and the second indicator 32 attached to a pipe conduit 16 with the indicia 34 viewed through the sight holes 36 in the pivoting pointers 14 on the protractors 12 indicating zero degrees of bend which correlates to a straight conduit 16 of 180 degrees.

Figure 3:
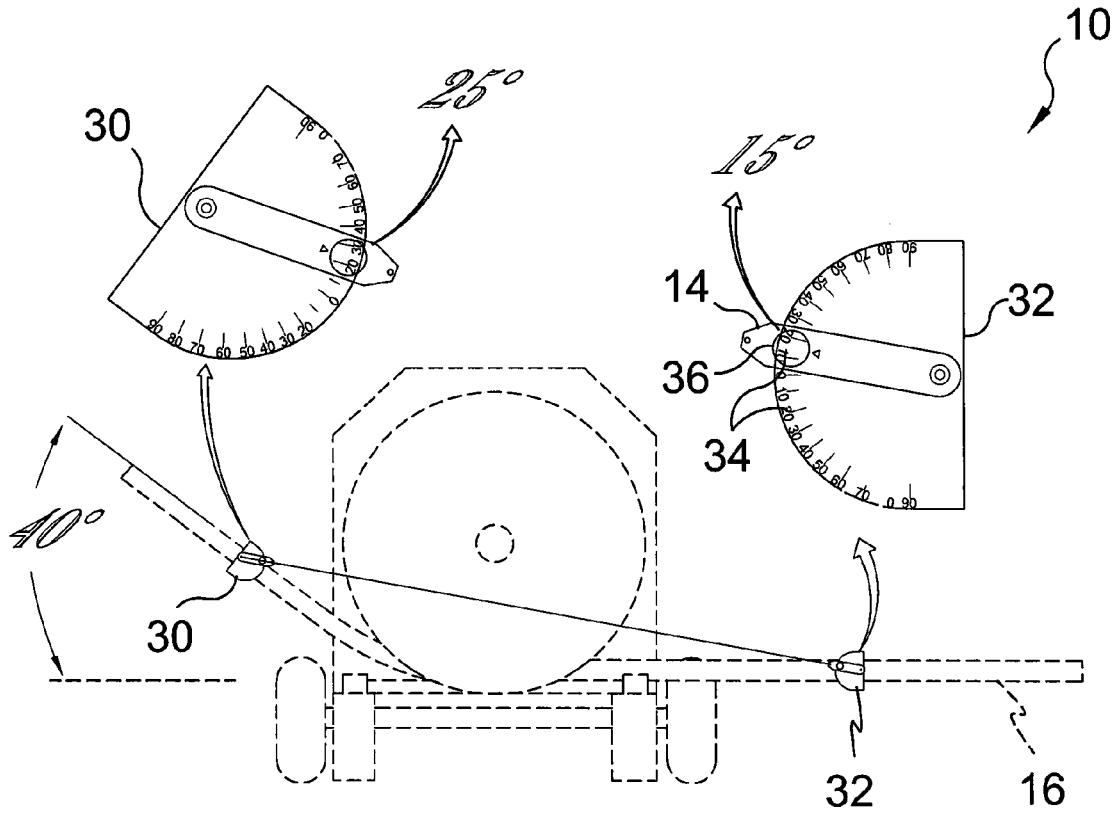
FIG. 3 is a perspective view of the present invention in use.

FIG. 3 is a perspective view of the present invention 10 in use. Shown is a length of pipe 16 being bent with the first angle indicator 30 pointing at 25 degrees and the second 32 pointing at 15 degrees as identified by the indicia 34 viewed through the sight holes 36 in their respective pointers 14. By adding both angular displacements the total bend is 40 degrees from the horizontal. The tool enables the operator of any bending device to quickly, simply and accurately determine the angle of a conduit 16 as it is being bent without removing it from the bending device.

Figure 4:
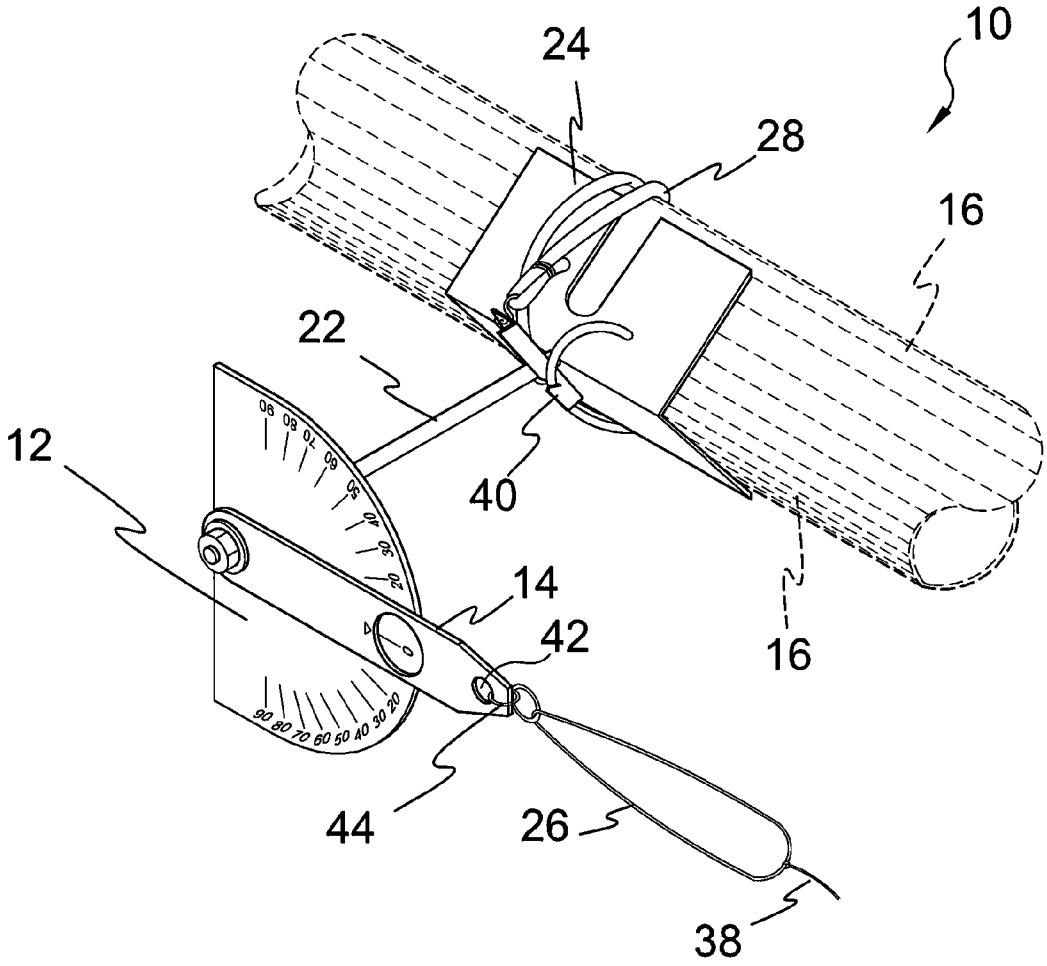
FIG. 4 is a perspective view of the present invention in use.

FIG. 4 is a perspective view of the present invention 10 in use. Illustrated is the present invention 10 attached to a large conduit 16 comprising a right angled base bracket 24 and an elastic band 28 for securing to variously sized pipe 16. The base 24 has a stand-off 22 projecting therefrom with a protractor 12 attached thereto and a rotative pointer 14 with an elastomeric cord 26 and static line 38 extending to a mating apparatus attached in similar fashion. The elastic band 28 wraps around the conduit 16 and the base 24 until forming a secure connection hugging the conduit 16 against the base 24 and locks into a J-clip 40 disposed on the stand off 22 proximal the base 24. The pointer 14 has an attachment recess 42 for accepting an attachment hook 44 on the end of the elastomeric cord 26 opposing the static line 38.

Figure 5:
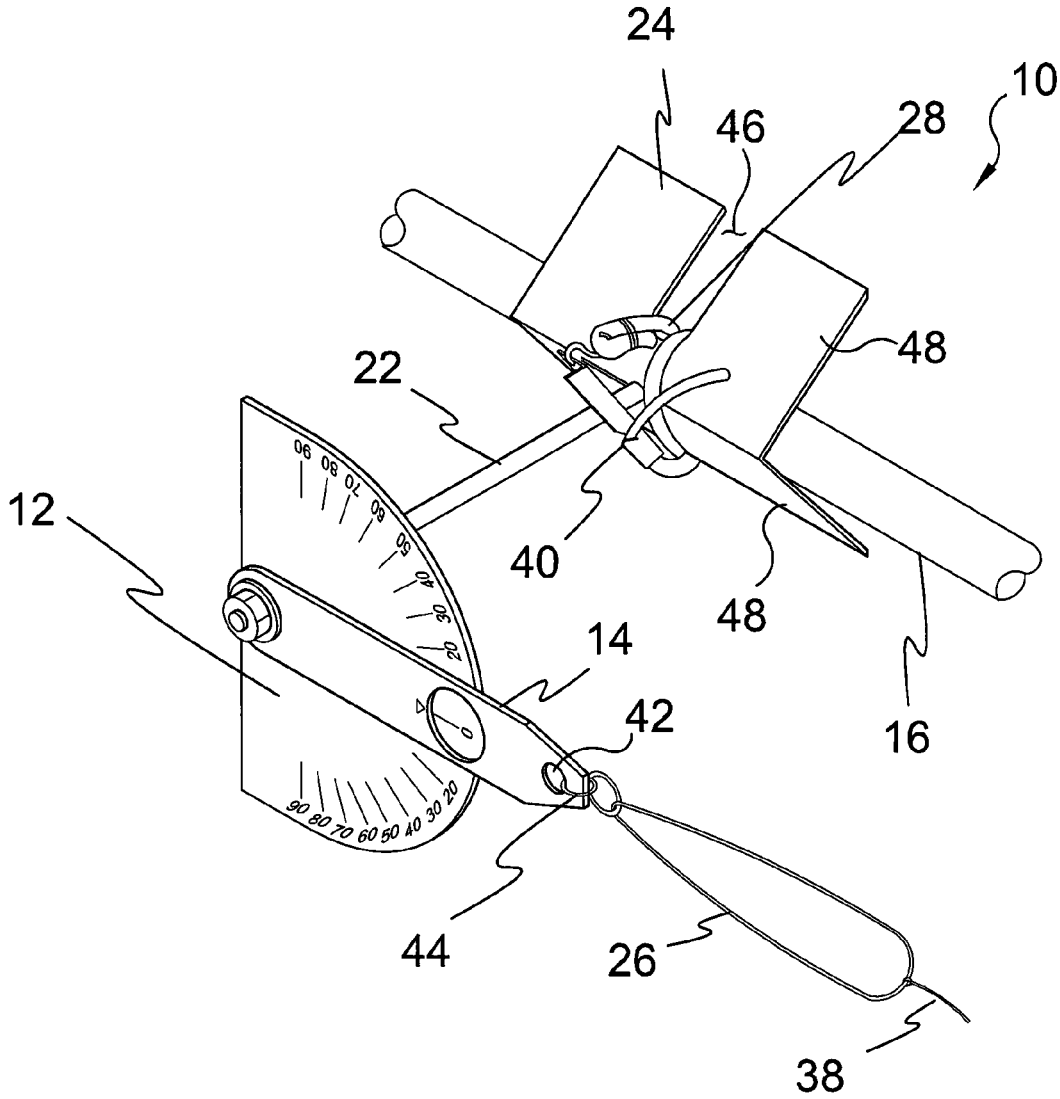
FIG. 5 is a perspective view of the present invention in use.

FIG. 5 is a perspective view of the present invention 10 in use. Illustrated is the present invention 10 attached to a smaller conduit 16 comprising a right angled base bracket 24 and an elastic band 28 for securing to variously sized pipe 16. The base 24 has a stand-off 22 projecting therefrom with a protractor 12 attached thereto and a rotative pointer 14 with an elastomeric cord 26 and static line 38 extending to a mating apparatus attached in similar fashion. The elastic band 28 wraps around the conduit 16 and the base 24 until forming a secure connection hugging the conduit 16 against the base 24 and locks into a J-clip 40 disposed on the stand off 22 proximal the base 24. A channel 46 is provided in the base 24 for accepting the elastic band 28 when the diameter of the conduit 16 does not exceed the length of the base plates 48. The pointer 14 has an attachment recess 42 for accepting an attachment hook 44 on the end of the elastomeric cord 26 opposing the static line 38.

Figure 6:
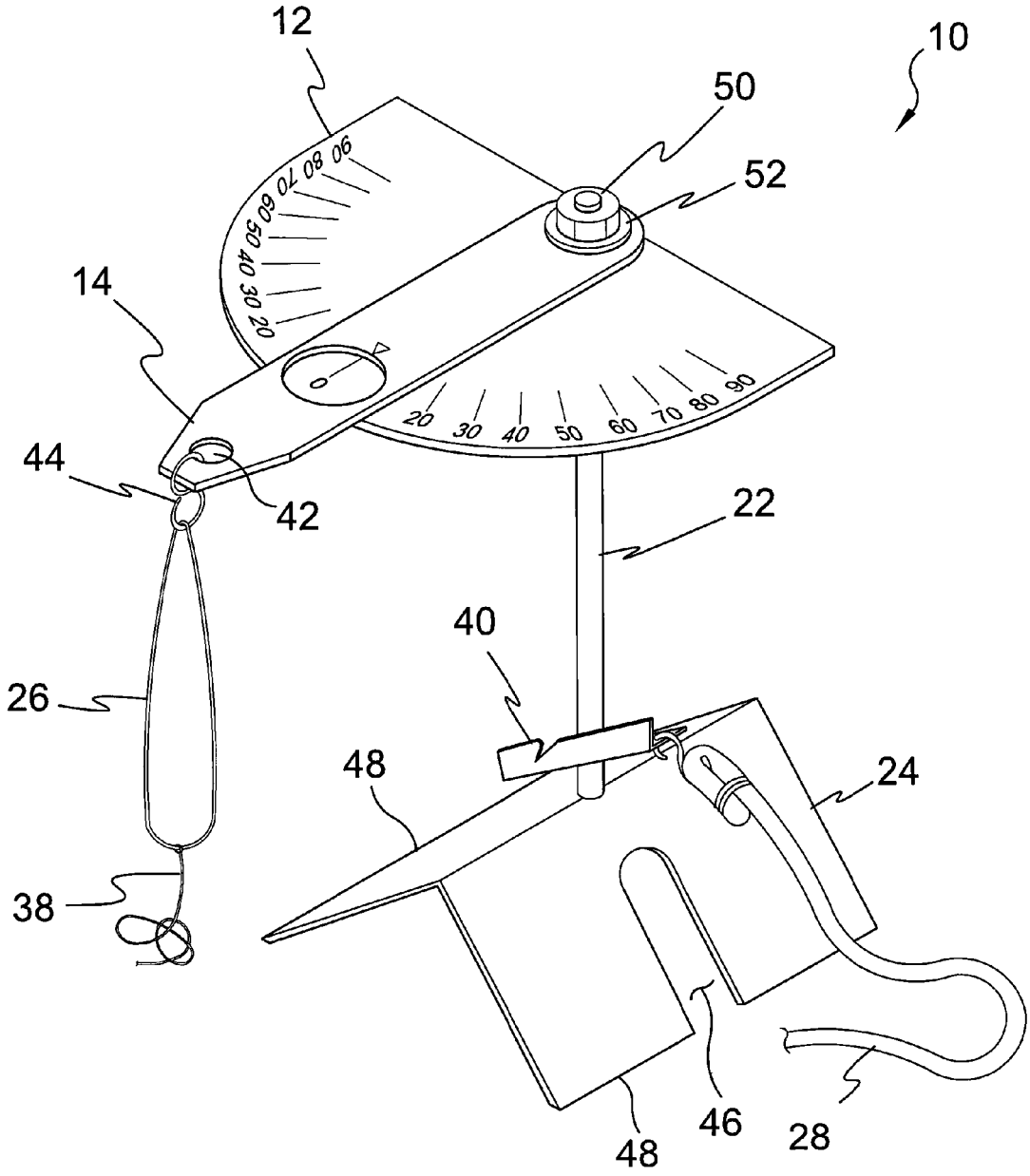
FIG. 6 is a perspective view of the present invention.

FIG. 6 is a perspective view of the present invention 10. The present invention 10 is an angle indicator mountable to any pliant rod-like material, especially tubing, that when used in pairs in a bending operation by securing both to the rod-like material in a spaced relationship will cumulatively indicate angular displacement of the material positioned between the angle indicators from a 180 degree starting point, thereby enabling the operator of any bending device to accurately determine the angle of the rod-like material as it is being bent without removing it from the bending device. An elastic band 28 is provided for securing to variously sized pipe thereto. The base 24 has a stand-off 22 projecting therefrom with a protractor 12 attached thereto and a rotative pointer 14 with an elastomeric cord 26 and static line 38 extending to a mating apparatus attached in similar fashion. The elastic band 28 wraps around the conduit 16 and the base 24 until forming a secure connection hugging the conduit 16 against the base 24 and locks into a J-clip 40 disposed on the stand off 22 proximal the base 24. A channel 46 is provided in the base 24 for accepting the elastic band 28 when the diameter of the conduit 16 does not exceed the length of the base plates 48. The pointer 14 has an attachment recess 42 for accepting an attachment hook 44 on the end of the elastomeric cord 26 opposing the static line 38. The pivoting pointer 14 is attached to the protractor 12 with a hex nut 50 and a washer 52.

Figure 7:
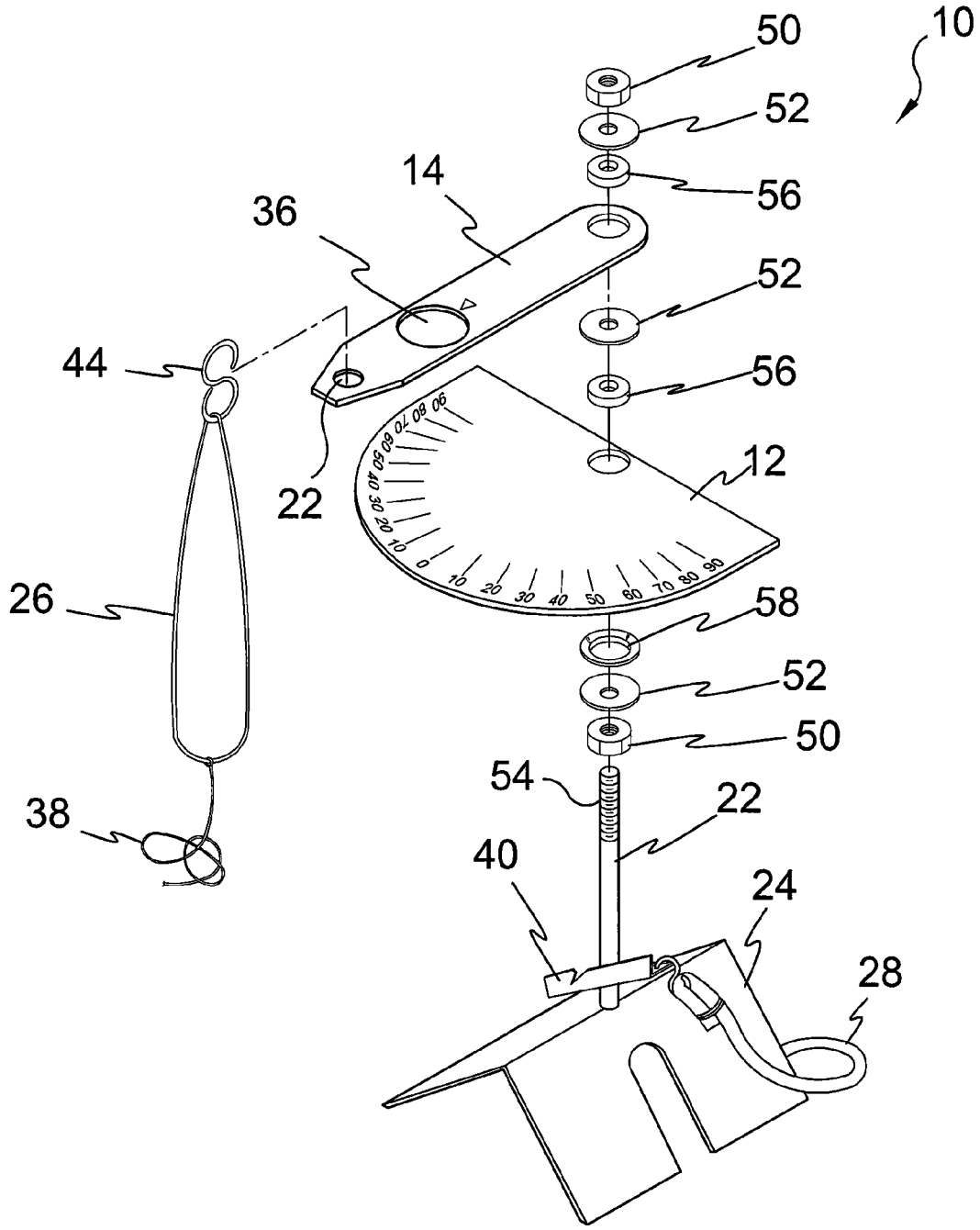
FIG. 7 is an exploded view of the angle indicator.

FIG. 7 is an exploded view of the angle indicator. Shown is an angle indicator of the present invention 10 that is used in pairs to accurately determine the angle of rod-like material as it is being bent during a bending process without removing the material from the bending apparatus. As illustrated, the angle indicator comprises a bracket base 24 for attachment to a pliable material, a stand off post 22 extending from the base 24 and a protractor 12 depicting indicia 34 denoting angle gradients. A pivoting pointer 14 is mounted to the protractor 12 at the threaded 54 distal end of the stand off 22. The tether extends to a correspondingly mounted mating angle indicator and is secured in similar fashion to the other indicator's pointer. The stand-off 22 prevents the attached angle-pointer tether from engaging any parts of the material or bending apparatus by spacing the tether away from the bending apparatus and from the material being bent. The base 24 has a stand-off 22 projecting therefrom with a protractor 12 attached thereto and a rotative pointer 14 with an elastomeric cord 26 and static line 38 extending to a mating apparatus attached in similar fashion. The elastic band 28 wraps around the conduit 16 and the base 24 until forming a secure connection hugging the conduit 16 against the base 24 and locks into a J-clip 40 disposed on the stand off 22 proximal the base 24. The pointer 14 has an attachment recess 42 for accepting an attachment hook 44 on the end of the elastomeric cord 26 opposing the static line 38. The hardware securing the protractor 12 and pointer 14 in spaced apart relation to the stand off 22 include hex nuts 50, washers 52, sleeve spacers 56 and a friction washer 58.

Figure 8:
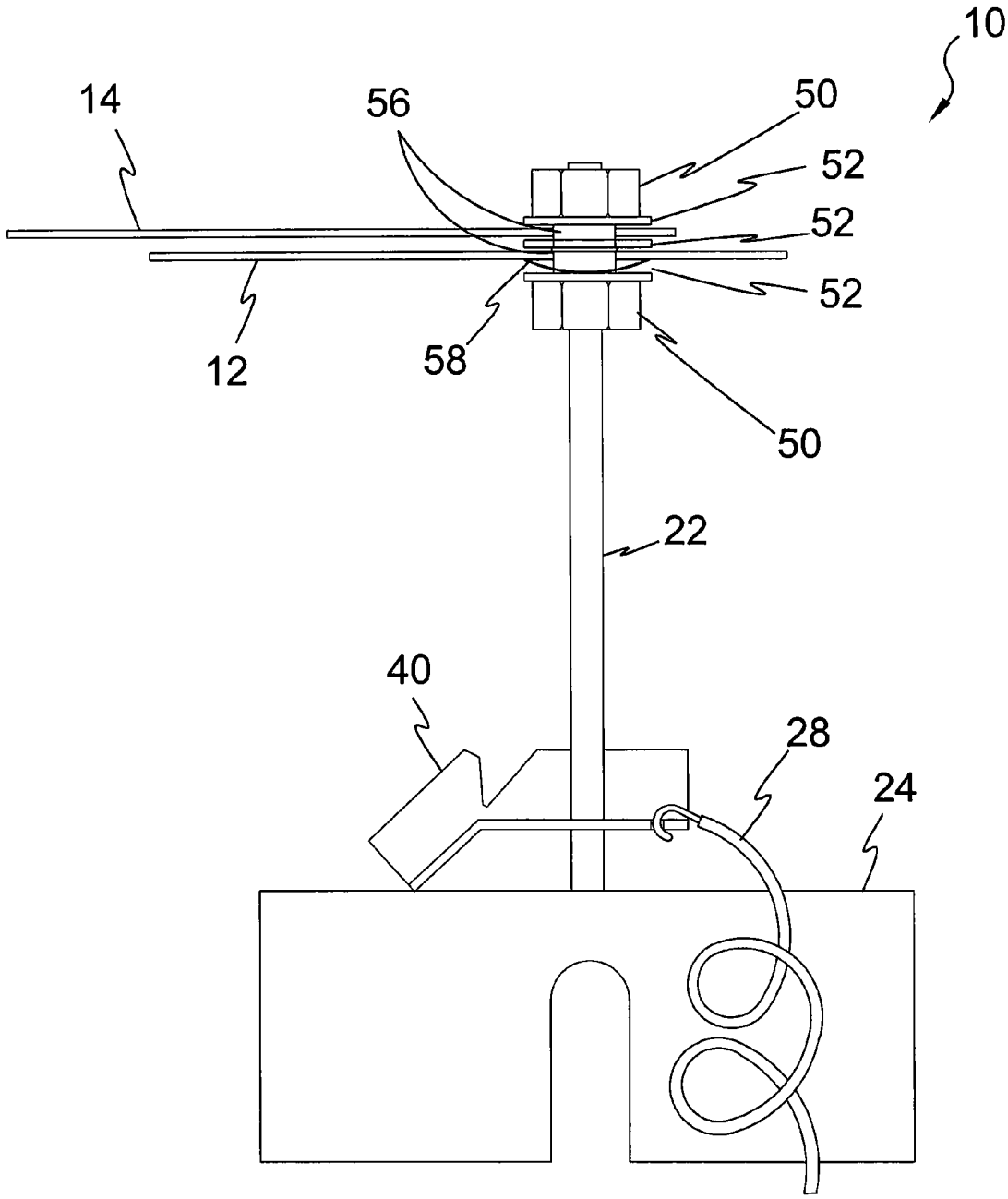
FIG. 8 is a side view of the assembled angle indicator.

FIG. 8 is a side view of an assembled angle indicator. The present invention 10 provides appropriate spacers 56, washers 52 and friction washer 58 which serve to tension the protractor 12 from casual movement and provide free movement of the protractor's pointer 14 during use. The hardware securing the protractor 12 and pointer 14 in spaced apart relation to the stand off 22 include hex nuts 50, washers 52, sleeve spacers 56 and a friction washer 58. Also shown is the spatial relation of the J-clip 40 to the base 24 and the elastic band 28 attached thereto.

Figure 9:
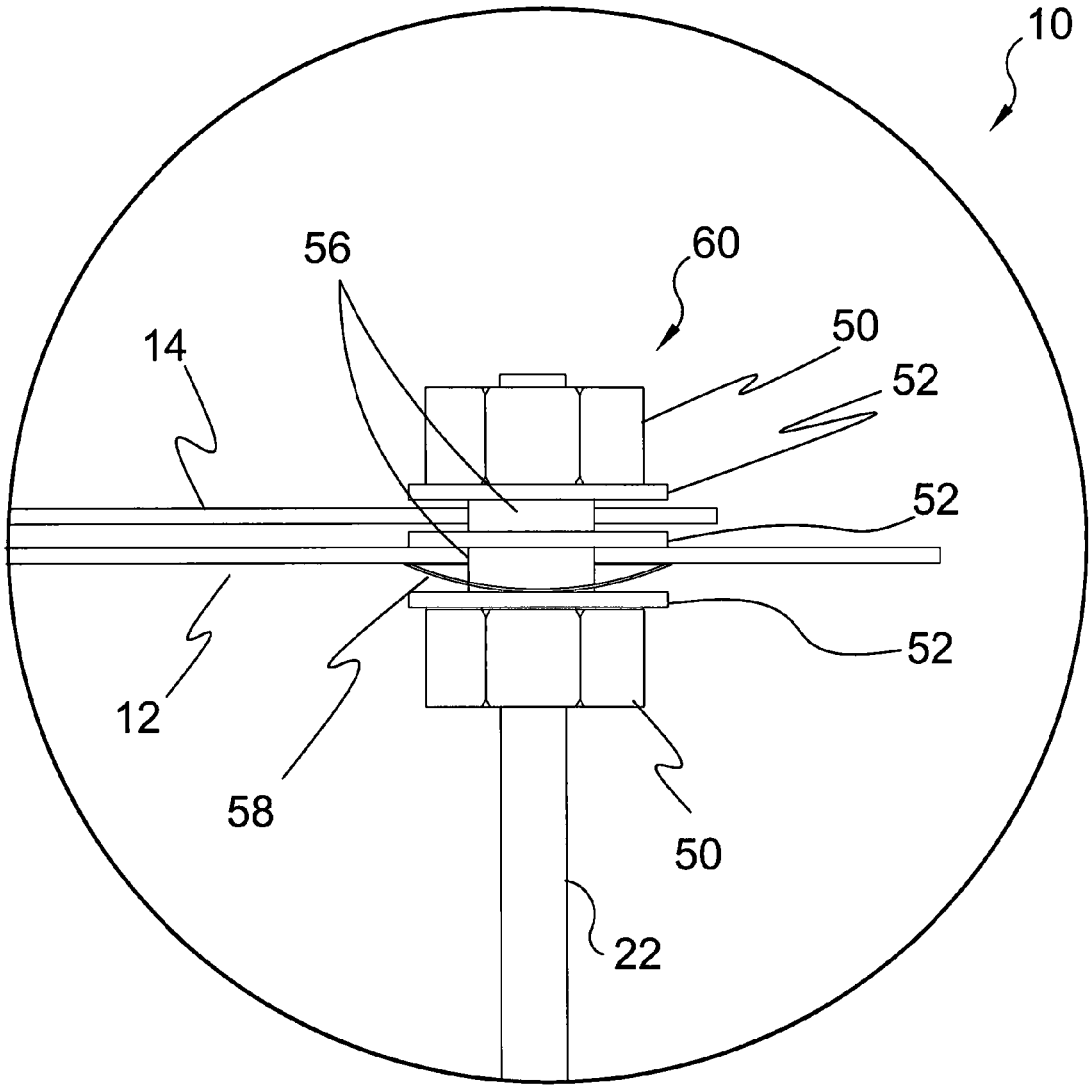
FIG. 9 is an enlarged view of the stand-off and attached protractor and pointer.

FIG. 9 is an enlarged view of the stand-off 22 and attached protractor 12 and pointer 14. As illustrated, the stand-off 22 serves as attachment for the protractor 12 and pointer 14 with an assortment of washers, spacers and spring to prevent casual movement of the protractor 12 during a bending operation while affording the pointer 14 free movement about the stand-off 22 with the actual pointer 14 movement governed by the tether tensioned between spaced apart angle indicators and secured to their respective angle-indicator pointers. The present invention 10 provides appropriate spacers 56, washers 52 and spring which serve to tension the protractor 12 from casual movement and provide free movement of the protractor's pointer 14 during use. The hardware securing the protractor 12 and pointer 14 in spaced apart relation to the stand off 22 include hex nuts 50, washers 52, sleeve spacers 56 and a friction washer 58.

Figure 10:
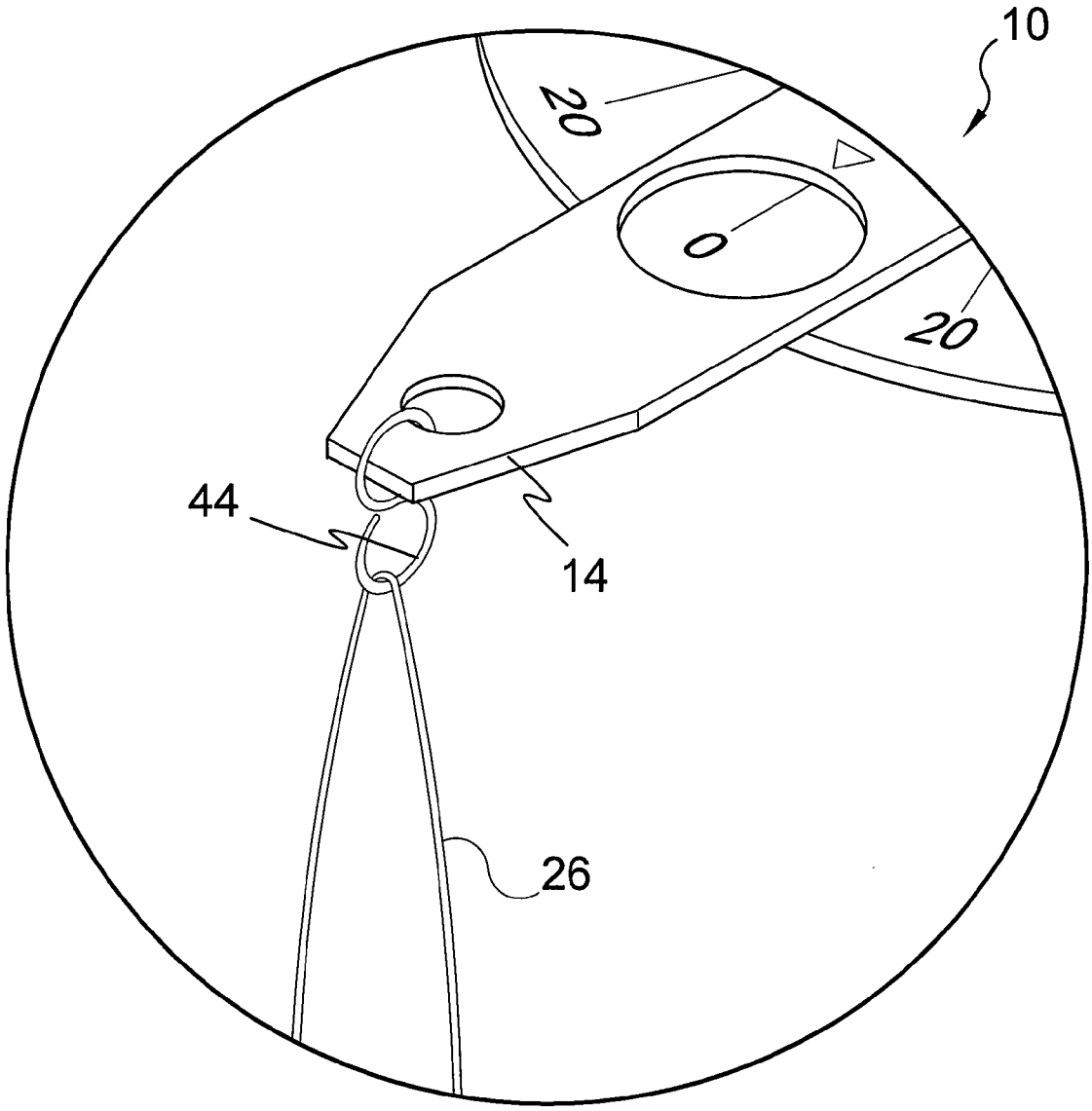
FIG. 10 is an enlarged view of the pointer tensioning member.

FIG. 10 is an enlarged view of the pointer tensioning assembly 60. Depicted is the pointer 14 having an elastomeric cord 26 and line that attaches to the pointer 14 of another device attached down line. The elastomeric cord 26 is secured to the pointer 14 with an attachment hook 44. While the tether is depicted as a line and elastic cord, the present invention 10 provides that the tether could be one or more lines fastened between angle-indicator pointers 14. The criteria for the line is that it maintains tension on the angle-indicator pointers 14 during a bending process. The present invention provides that any material or device that is capable of maintaining tension on the angle-indicator pointers 14 during a bending process providing enablement of a tensioned tether would serve the present invention 10 as that disclosed in the accompanying figures.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A pipe-bending clinometer for use in conjunction with a pipe bending device for quickly and precisely measuring the angle of a bend during the pipe bending process, the clinometer comprising:

a) a first indicator device having a protractor and a pivotable pointer wherein said first indicator is selectively and removably attachable to a length of pipe to be bent to a specific angle;

b) a second indicator device having a protractor and a pivotable pointer wherein said second indicator is attachable to the pipe in a position on the opposite side of the pipe to be bent relative to said first indicator;

c) a tether line having elastomeric properties communicating between the distal ends of said pivotal pointers of said first indicator and said second indicator;

d) a sight hole disposed proximal said distal end of each said pivotal pointer positioned to enable the user to view numeric indicia on the respective protractor therebelow for calculating the current status of the bend during the bending process; and e) means for releasably securing said indicators to the pipe.

2. The pipe-bending clinometer recited in claim 1, wherein said indicator securing means comprises:

a) a base having two plates joined together at a right angle;

b) a standoff rod projecting centrally from the juncture of said base plates; and c) an elastic band associated with said standoff rod for providing a quick and simple means for providing a reliable tension connection between said base and said conduit regardless of the diameter of the pipe.

3. The pipe-bending clinometer recited in claim 2, wherein said standoff includes a J-clip with a substantially vertical wall and a substantially horizontal wall integral with said stand off proximal said base.

4. The pipe-bending clinometer recited in claim 3, wherein said J-clip further includes an angular projection depending downward from one end thereof having a notch disposed in the horizontal portion thereof for receiving and securing said elastic band.

5. The pipe-bending clinometer recited in claim 4, wherein said J-clip further includes a recess for retaining an end of said elastic band.

6. The pipe-bending clinometer recited in claim 5, wherein the pipe is placed inside of said base and said elastic band is secured to said recess of said J-clip and said band is tightly wrapped around to form a secure bond and said band is urged into said notch of said J-clip until released by the user.

7. The pipe-bending clinometer recited in claim 6, wherein said base includes a base channel disposed in at least one said base plate for passage of said elastic band therethrough to provide a secure connection when the diameter of the pipe is less than the width of said base plates.

8. The pipe-bending clinometer recited in claim 2, wherein said standoff rod provides an offset distance between the pipe and said protractor, pivoting pointer and the tether line thereby allowing the tether line to clear any obstructions as the bending progresses.

9. The pipe-bending clinometer recited in claim 8, wherein each said pivoting pointer is spaced apart from its respective protractor to prevent friction thereagainst during the pivoting thereof.

10. The pipe-bending clinometer recited in claim 9, wherein a distal end of said standoff rod is threaded.

11. The pipe-bending clinometer recited in claim 10, wherein said protractor and said pivoting pointer are secured to said threaded end of said stand off in a fashion which retains said protractor in a stationary position and yet enables said pivoting pointer to pivot freely through the use of a plurality of hex nuts, washers, sleeve spacers and a friction washer that allows adjustment of the protractor to "zero" while preventing casual and accidental movement.

12. The pipe-bending clinometer recited in claim 1, wherein said tether line includes an attachment hook at each end to be secured to attachment recesses disposed between the distal end of said pivoting pointer and said sight hole.

13. The pipe-bending clinometer recited in claim 12, wherein said tether line comprises a static central line with elastomeric cords disposed on the ends thereof.

14. The pipe-bending clinometer recited in claim 1, wherein the user places the pipe into said bending device.

15. The pipe-bending clinometer recited in claim 14, wherein the user secures the base of said first indicator to said pipe on one side of said bending device and the base of said second indicator to a section of the pipe on the opposing side of said pipe wherein said both pivoting pointers are linearly parallel and said sight holes on each reveal the 0 degree angle indicia on said protractor therebelow thus indicating a 180 degree status of said pipe.

16. The pipe-bending clinometer recited in claim 15, wherein the user bends said pipe and monitors said sight holes until the sum of the two numbers revealed in said sight hole equal the value of the desired degree of the bend.

* * * * *